US011792896B2

(12) United States Patent
Duncan et al.

(10) Patent No.: US 11,792,896 B2
(45) Date of Patent: Oct. 17, 2023

(54) ELECTROMAGNETIC WAVE REDUCING HEATER

(71) Applicant: Sauna Works Inc., Berkeley, CA (US)

(72) Inventors: Raleigh C. Duncan, Berkeley, CA (US); Andrew Kaps, San Francisco, CA (US)

(73) Assignee: SAUNA WORKS INC., Berkeley, CA (US)

( * ) Notice: Subject to any disclaimer, the term of this patent is extended or adjusted under 35 U.S.C. 154(b) by 319 days.

(21) Appl. No.: 17/101,909

(22) Filed: Nov. 23, 2020

(65) Prior Publication Data

US 2021/0076461 A1 Mar. 11, 2021

Related U.S. Application Data

(63) Continuation of application No. 15/806,262, filed on Nov. 7, 2017, now Pat. No. 10,869,367, which is a continuation of application No. 13/427,899, filed on Mar. 23, 2012, now Pat. No. 9,844,100.

(60) Provisional application No. 61/467,884, filed on Mar. 25, 2011.

(51) Int. Cl.
*H05B 6/44* (2006.01)
*H05B 1/02* (2006.01)

(52) U.S. Cl.
CPC ..... *H05B 6/44* (2013.01)

(58) Field of Classification Search
CPC ..... H05B 6/44; H05B 2203/011; H05B 2203/013; H05B 2203/014; H05B 3/26; D03D 7/00; D04B 21/12; D04B 21/14; D04B 21/18; D04B 39/06; D10B 2501/043
USPC .... 219/212, 213, 528, 529, 548, 549, 466.1, 219/545, 553, 554, 505, 600; 338/211, 338/212, 312, 255, 275, 276, 308; 392/432; 324/95, 119, 142
See application file for complete search history.

(56) References Cited

U.S. PATENT DOCUMENTS

| | | | | |
|---|---|---|---|---|
| 2,146,977 A | | 2/1939 | Emil | |
| 2,416,977 A | | 3/1947 | Brown et al. | |
| 5,023,433 A | | 6/1991 | Gordon | |
| 5,296,686 A | | 3/1994 | Ullrich et al. | |
| 5,761,377 A | | 6/1998 | Wolfe et al. | |
| 5,796,076 A | * | 8/1998 | Azuma | H05B 1/0283 219/486 |
| 5,889,923 A | | 3/1999 | Lee et al. | |
| 6,300,597 B1 | | 10/2001 | Lee | |

(Continued)

FOREIGN PATENT DOCUMENTS

| | | |
|---|---|---|
| CN | 201639794 U | 11/2010 |
| CN | 206237620 U | 6/2017 |

(Continued)

OTHER PUBLICATIONS

Translation of JP 10-261542A, Capacitor and Its manufacture, Sep. 29, 1998, by ProQuest. (Year: 1998).*

(Continued)

*Primary Examiner* — Quang T Van
(74) *Attorney, Agent, or Firm* — Kwan & Olynick LLP

(57) ABSTRACT

A heater with reduced electromagnetic wave emissions, comprising two heating elements separated by an insulating layer and receiving opposite-phase alternating current in a way that cancels out electromagnetic wave emissions.

20 Claims, 4 Drawing Sheets

(56) References Cited

U.S. PATENT DOCUMENTS

| | | | |
|---|---|---|---|
| 7,120,353 | B2 | 10/2006 | Schaeffer et al. |
| 7,538,279 | B2 | 5/2009 | Lee |
| 8,692,168 | B2 | 4/2014 | Benda et al. |
| 9,844,100 | B2 | 12/2017 | Duncan et al. |
| 11,202,346 | B2 | 12/2021 | Duncan et al. |
| 11,471,376 | B2 | 10/2022 | Duncan |
| 2003/0031471 | A1 | 2/2003 | Schneider et al. |
| 2006/0180336 | A1 | 8/2006 | King et al. |
| 2006/0289463 | A1 | 12/2006 | Kil |
| 2007/0110413 | A1 | 5/2007 | Konishi |
| 2008/0143249 | A1 | 6/2008 | Lee et al. |
| 2008/0292293 | A1 | 11/2008 | Song |
| 2009/0279879 | A1 | 11/2009 | Zenteno et al. |
| 2010/0072892 | A1 | 3/2010 | Watanabe et al. |
| 2012/0241440 | A1 | 9/2012 | Duncan et al. |
| 2013/0187066 | A1 | 7/2013 | Heller et al. |
| 2014/0374403 | A1 | 12/2014 | Smith |
| 2018/0063898 | A1 | 3/2018 | Duncan et al. |
| 2019/0110339 | A1 | 4/2019 | Duncan et al. |
| 2020/0100984 | A1 | 4/2020 | Duncan |
| 2021/0368590 | A1 | 11/2021 | Duncan et al. |

FOREIGN PATENT DOCUMENTS

| | | | |
|---|---|---|---|
| JP | S588673 | A | 1/1983 |
| JP | H07312277 | A | 11/1995 |
| JP | H10261542 | A | 9/1998 |
| WO | 2020113134 | A1 | 6/2020 |

OTHER PUBLICATIONS

Translation of CN2016397794U, , Novel low-electromagnetic radiation planar heating body, Nov. 17, 2010, by ProQuest. (Year: 2010).*
"Advisory Action", Advisory Action U.S. Appl. No. 13/427,899, dated Sep. 27, 2016, 3 pages.
"Final Office Action", Final Office Action, U.S. Appl. No. 13/427,899, dated Aug. 24, 2015, 6 pages.
"Int'l Application Serial No. PCT/US17/45171, Int'l Search Report and Written Opinion dated Oct. 12, 2017", 7 pages.
"Non-Final Office Action", Non-Final Office Action, U.S. Appl. No. 13/427,899, dated Feb. 12, 2015, 5 pages.
"U.S. Appl. No. 13/427,899, Advisory Action dated Jun. 8, 2017", 3 pages.
"U.S. Appl. No. 13/427,899, Final Office Action dated Mar. 31, 2017", 8 pages.
"U.S. Appl. No. 13/427,899, Notice of Allowance dated Aug. 8, 2017", 5 pgs.
Advisory Action Advisory Action U.S. Appl. No. 13/427,899, dated Sep. 27, 2016, 3 pgs.
Advisory Action U.S. Appl. No. 13/427,899, dated Sep. 27, 2016, 3 pgs.
U.S. Appl. No. 15/806,262, Final Rejection, dated Mar. 2, 2020, 7 pgs.
U.S. Appl. No. 15/806,262,Notice of Allowance and Fees Due (Ptol-85), dated Aug. 13, 2020, 7 pgs.
U.S. Appl. No. 16/206,706, Non-Final Rejection, dated Nov. 20, 2020, 11 pgs.
U.S. Appl. No. 13/427,899, Advisory Action dated Jun. 8, 2017, 3 pgs.
U.S. Appl. No. 13/427,899, Final Office Action dated Mar. 31, 2017, 8 pgs.
U.S. Appl. No. 15/226,756, Final Office Action dated Mar. 18, 2019, 16 pgs.
U.S. Appl. No. 15/226,756, Non Final Office Action dated Jul. 6, 2018, 14 pgs.
U.S. Appl. No. 15/806,262, Final Office Action dated Jan. 17, 2019, 9 pgs.
U.S. Appl. No. 15/806,262, Non Final Office Action dated Jun. 20, 2018, 6 pgs.
U.S. Appl. No. 15/806,262, Non Final Office Action dated Jul. 15, 2019, 6 pgs.
Final Office Action, Final Office Action, U.S. Appl. No. 13/427,899, dated Aug. 24, 2015, 6 pgs.
Final Office Action, U.S. Appl. No. 13/427,899, dated Aug. 24, 2015, 6 pgs.
Final Office Action, U.S. Appl. No. 13/427,899, dated Aug. 24, 2015, 7 pgs.
International Application Serial No. PCT/US19/63797, Search Report and Written Opinion dated 02-25-208 pgs.
Int'l Application Serial No. PCT/US17/45171, Int'l Search Report and Written Opinion dated Oct. 12, 2017, 7 pgs.
Non-Final Office Action, Non-Final Office Action, U.S. Appl. No. 13/427,899, dated Feb. 12, 2015, 5 pgs.
Non-Final Office Action, U.S. Appl. No. 13/427,899, dated Feb. 12, 2015, 5 pgs.
U.S. Appl. No. 15/806,262, Final Office Action dated Jan. 17, 2019, 16 pages.
U.S. Appl. No. 15/806,262, Non-Final Office Action dated Jun. 20, 2018, 9 pages.
U.S. Appl. No. 16/693,109, Notice of Allowance dated Jun. 24, 2022, 8 pgs.
U.S. Appl. No. 16/206,706, Notice of Allowance dated Aug. 13, 2021, 8 pgs.
U.S. Appl. No. 16/693,109, Final Office Action dated 2/10/228 pgs.
U.S. Appl. No. 16/693, 109, Non-Final Office Action dated Jun. 11, 2021, 8 pgs.
U.S. Appl. No. 16/206,706, Notice of Allowance dated May 4, 2021, 8 pgs.
International Application Serial No. PCT/US19/63797, Preliminary Report on Patentability dated Jun. 10, 2021, 6 pgs.
U.S. Appl. No. 17/394,315, USPTO e-Office Action: NOA—Notice of Allowance, dated Feb. 14, 2023, 17 pages.

* cited by examiner

ELECTROMAGNETIC WAVE REDUCING HEATER

CROSS-REFERENCE TO RELATED APPLICATIONS

The present application is a continuation of U.S. patent application Ser. No. 15/806,262, filed Nov. 7, 2017, which is a continuation of Ser. No. 13/427,899, filed Mar. 23, 2012, now issued as U.S. Pat. No. 9,844,100 on Dec. 12, 2017, which claims the benefit of U.S. provisional patent application No. 61/467,884, filed Mar. 25, 2011, which are incorporated herein by reference in its entirety.

FIELD OF THE INVENTION

The present invention relates to heating elements, specifically to a planar electric heating element that has low electromagnetic wave emissions.

BACKGROUND

As crude oil prices surge and remain very high, people are paying more attention to electric heating. Electric heating utilizes either linear heating elements made out of nickel and heating wires, or planar heating elements made of spread carbon microfiber or carbon micro powder. Electric heating makes it easy to control its temperature, does not pollute the air, and is sanitary and noiseless. Because it is quick to heat up and because it emits infrared rays, electric heating is very useful in many applications, such as residential buildings (apartment complexes, homes, and retirement communities), commercial buildings, industrial buildings (work yards, warehouses, and outdoor covered structures), and agricultural buildings.

Planar heating elements are a good way to deliver heat over a large surface. Some such planar heating elements utilize the resistance of carbon itself, which increases the efficiency and benefits of electric heating.

However, even though planar heating elements have many merits, many people are reluctant to use them because of the negative effects of the electromagnetic waves they emit. Electromagnetic waves are generated wherever electricity flows. There has been a suggestion that electromagnetic waves induce anxiety in humans and are harmful to general health. Since planar heating elements are typically used at close range, electromagnetic emissions are a serious concern. While a metal enclosure (or an enclosure made of another conductive material) can shield the user from electromagnetic waves, such an enclosure would severely lower the heat-generating efficiency of a planar heating element, which renders it impractical.

SUMMARY

The present invention drastically reduces electromagnetic wave emissions from a heater by using pairs of heaters, each powered by alternating current in opposite phases. The two heaters are located very close to each other so that the electromagnetic waves coming from one heater are canceled out by the electromagnetic waves coming from the other. The heating efficiency, however, is preserved. While the preferred embodiment of the invention uses planar heating elements, other embodiments may use other heater types, as long as those heater types can be paired in such a way as to cancel out each other's electromagnetic emissions.

In the preferred embodiment, the heating element of the present invention comprises two planar conductive elements, each one connected to electrodes at both poles; a layer of insulation between the two planar conductive elements; an insulation layer on the outside of each planar conductive element; and a means to cancel the electromagnetic fields generated around the planar conductive elements by connecting them to alternating current sources that are opposite in phase with respect to each other. This method of connection reduces the electromagnetic waves generated over the entire surface of the planar heating element, especially over the electrodes where the electromagnetic emissions are the strongest.

LIST OF FIGURES

DETAILED DESCRIPTION OF THE PREFERRED EMBODIMENT

Figure 1:
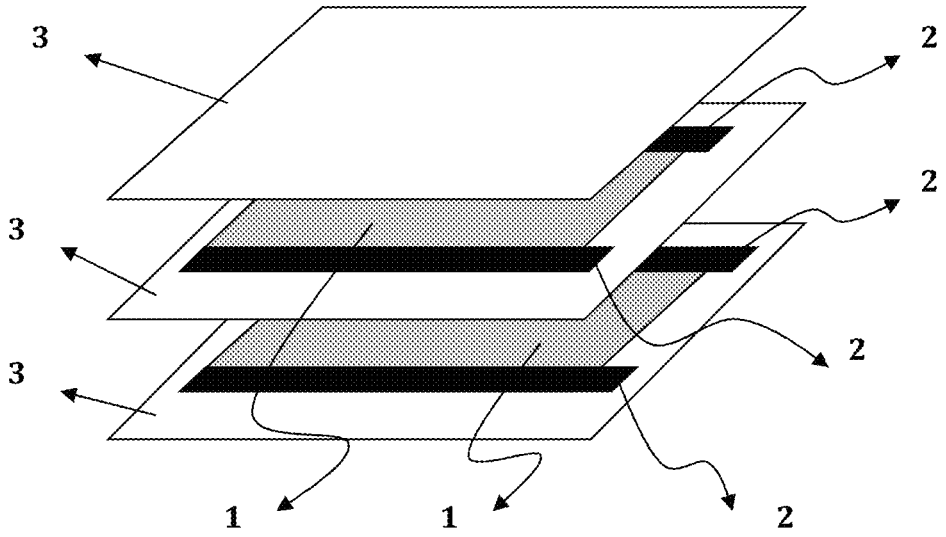
FIG. 1 shows an exploded view of a planar heating element of the present invention.

FIG. 1 shows the preferred embodiment of the invention. Planar conductive elements 1 are connected to electrodes 2. The planar conductive elements can be made of metal, of carbon powder or carbon fibers mixed in a binder and printed, coated, or impregnated on plastic film, fabric, or paper, of carbon fibers mixed in a paper form or carbon felt, or of etched metal foil. The electrodes can be made of either rolled or electrolyzed metal foil. Rolled metal foil is more commonly used thanks to its higher yield strength; a preferred thickness of the metal foil is about 20-60 microns. An insulation layer 3 is placed between the planar conductive elements and on the outside of each planar conductive element. For low-temperature planar heating elements of less than 80° C., polyester or heat-resistant plastic film or sheet is preferable, while for high-temperature planar heating elements of greater than 80° C., high heat resistant hardening resin such as hardening epoxy resin is preferable. The thickness of the insulation layer is preferably 100-200 microns in terms of its insulation characteristics, though it can be greater than 200 microns where excellent insulation characteristics are required. When external wire is connected to copper foil, soldering or wire-connecting terminals are used; the connection must be securely fastened to sustain substantial external force and properly insulated.

Figure 2:
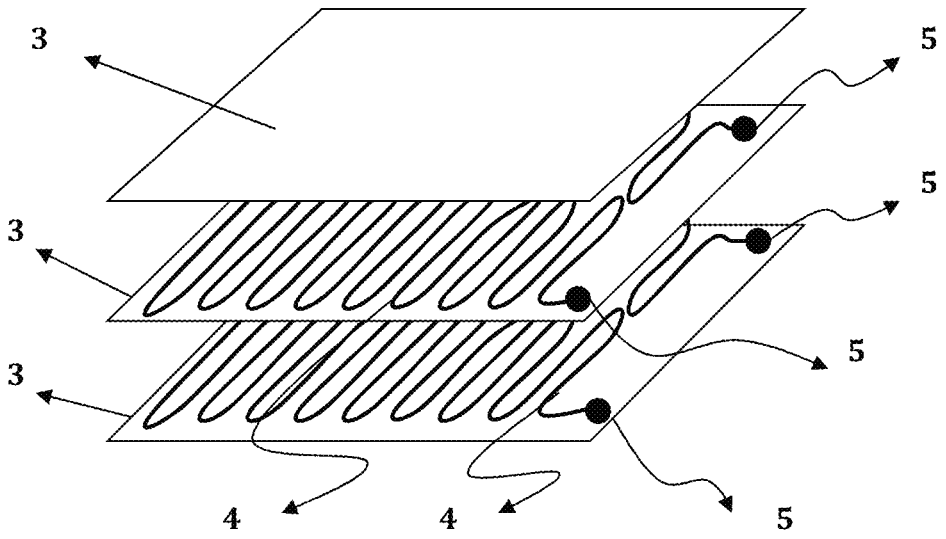
FIG. 2 shows an exploded view of an alternate embodiment of a planar heating element of the present invention.

FIG. 2 shows an alternate embodiment of the present invention, where the planar heating element 4 is made of metal and comprises a wire disposed in a planar fashion over the surface of the insulation 3. The planar heating element 4 is then connected to electrodes 5.

Figure 3:
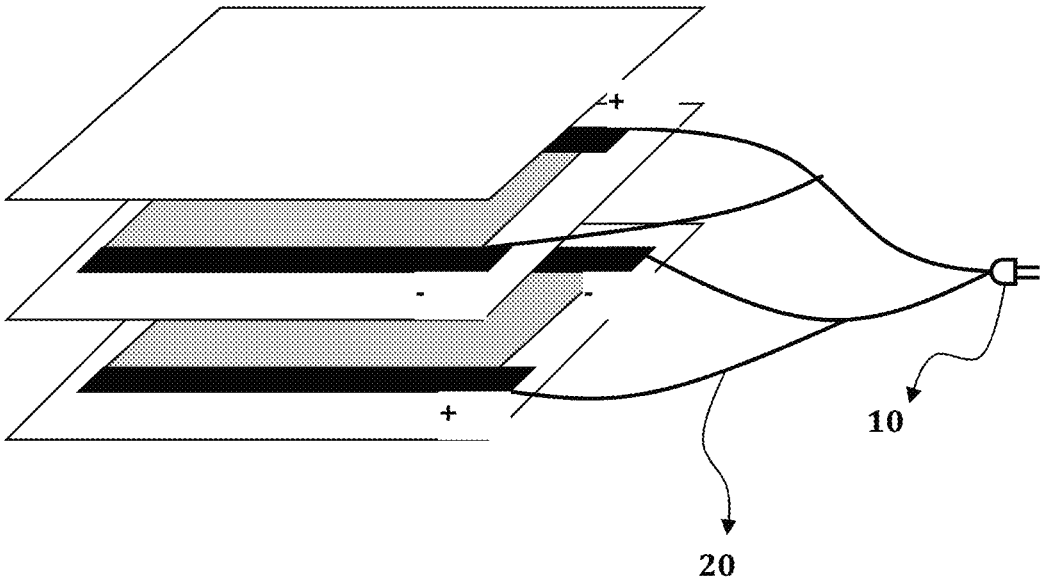
FIG. 3 shows an electrical diagram of a planar heating element of the present invention.
Figure 4:
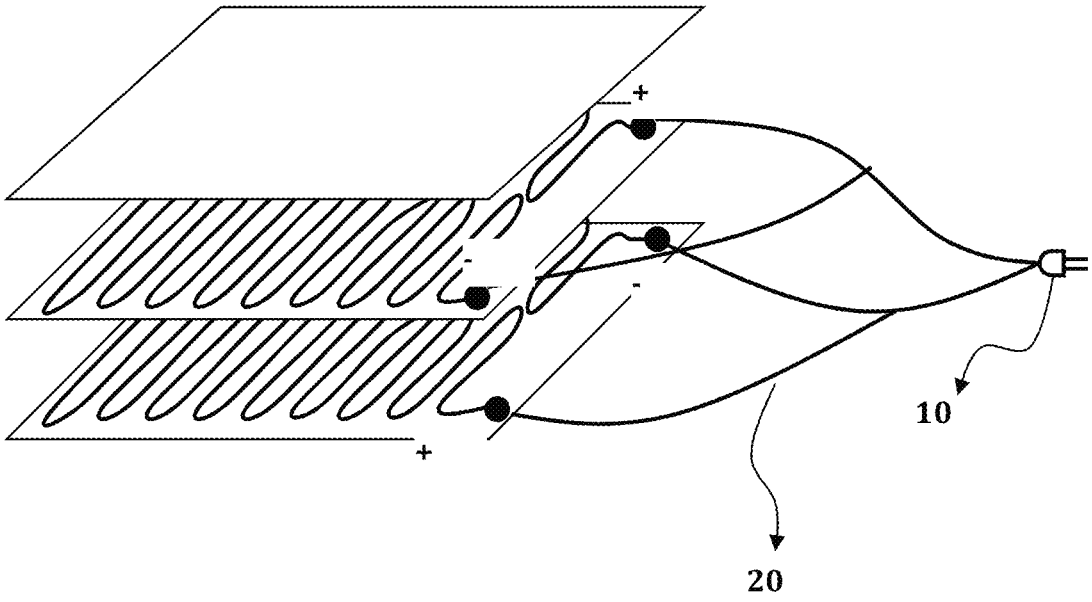
FIG. 4 shows an electrical diagram of an alternate embodiment of a planar heating element of the present invention.

FIGS. 3 and 4 show the electrical design of the preferred embodiment of the present invention. Electrical signal 10 is opposite in phase from electrical signal 20. As a result, the electromagnetic waves that are generated by one planar conductive element are canceled out by the electromagnetic waves generated by the other planar conductive element.

The invention claimed is:

1. A sauna, comprising:

a sitting area;

a first conductive heating element configured to generate heat directed to the sitting area using a first alternating current, wherein the first conductive heating element is a first planar heating element;

a second conductive heating element configured to generate heat using a second alternating current, wherein the second conductive heating element is a second planar heating element, wherein the first alternating current delivered to the first conductive heating element is opposite in phase to the second alternating current delivered to the second conductive heating element so that the electromagnetic emissions from the first conductive heating element are cancelled out by the electromagnetic emissions from the second conductive heating element;

an insulation layer between the first conductive heating element and the second conductive heating element;

a controller configured to change the amount of first alternating current and the second alternating current provided to the first conductive heating element and the second conductive heating element respectively.

2. The sauna of claim 1, wherein the first conductive heating element and the second conductive heating element are arranged such that their poles are opposite to each other.

3. The sauna of claim 1, wherein the first conductive heating element is a metal heating element.

4. The sauna of claim 1, wherein the second conductive heating element is a metal heating element.

5. The sauna of claim 1, wherein the first conductive heating element is a carbon impregnated material.

6. The sauna of claim 1, wherein the second conductive heating element is a carbon impregnated material.

7. The sauna of claim 1, wherein the first conductive heating element and the second conductive heating element are coupled to first electrodes and second electrodes, wherein the first electrodes and the second electrodes comprise metal foil.

8. The sauna of claim 7, wherein the metal foil has a first thickness that is less than a second thickness of the insulation layer.

9. The sauna of claim 7, wherein the first electrodes and the second electrodes are located at a relative position and distance with respect to each other such that the electromagnetic emissions coming from the first conductive heating element and first electrodes are cancelled out by the electromagnetic emissions coming from the second conductive heating element and second electrodes.

10. The sauna of claim 9, wherein the first conductive heating element and the second conductive heating element are carbon fiber planar heating elements.

11. An apparatus, comprising:

a first conductive heating element configured to generate heat using a first alternating current, wherein the first conductive heating element is a first planar heating element;

a second conductive heating element configured to generate heat using a second alternating current, wherein the second conductive heating element is a second planar heating element, wherein the first alternating current delivered to the first conductive heating element is opposite in phase to the second alternating current delivered to the second conductive heating element so that the electromagnetic emissions from the first conductive heating element are cancelled out by the electromagnetic emissions from the second conductive heating element;

an insulation layer between the first conductive heating element and the second conductive heating element;

a controller configured to change the amount of first alternating current and the second alternating current provided to the first conductive heating element and the second conductive heating element respectively.

12. The apparatus of claim 11, wherein the first conductive heating element and the second conductive heating element are arranged such that their poles are opposite to each other.

13. The apparatus of claim 11, wherein the first conductive heating element is a metal heating element.

14. The apparatus of claim 11, wherein the second conductive heating element is a metal heating element.

15. The apparatus of claim 11, wherein the first conductive heating element is a carbon impregnated material.

16. The apparatus of claim 11, wherein the second conductive heating element is a carbon impregnated material.

17. The apparatus of claim 11, wherein the first conductive heating element and the second conductive heating element are coupled to first electrodes and second electrodes, wherein the first electrodes and the second electrodes comprise metal foil.

18. The apparatus of claim 17, wherein the metal foil has a first thickness that is less than a second thickness of the insulation layer.

19. The apparatus of claim 17, wherein the first electrodes and the second electrodes are located at a relative position and distance with respect to each other such that the electromagnetic emissions coming from the first conductive heating element and first electrodes are cancelled out by the electromagnetic emissions coming from the second conductive heating element and second electrodes.

20. The apparatus of claim 19, wherein the first conductive heating element and the second conductive heating element are carbon fiber planar heating elements.

* * * * *